US007736282B1

(12) United States Patent
Horowitz

(10) Patent No.: US 7,736,282 B1
(45) Date of Patent: Jun. 15, 2010

(54) BIKE TRAINER

(76) Inventor: Mark Horowitz, 71 NE. 48 Ct., Oakland Park, FL (US) 33334

( * ) Notice: Subject to any disclaimer, the term of this patent is extended or adjusted under 35 U.S.C. 154(b) by 112 days.

(21) Appl. No.: 11/805,118

(22) Filed: May 22, 2007

(51) Int. Cl.
*A63B 22/06* (2006.01)
*A63B 69/16* (2006.01)

(52) U.S. Cl. ..... 482/61; 482/57; 482/65

(58) Field of Classification Search ..... 482/57, 482/61, 904, 908, 65; 211/17, 20, 22–24; 434/61, 247
See application file for complete search history.

(56) References Cited

U.S. PATENT DOCUMENTS

| | | | | |
|---|---|---|---|---|
| 4,593,898 | A * | 6/1986 | McLerran et al. | 482/61 |
| 5,042,795 | A * | 8/1991 | Bursik | 482/61 |
| 6,126,577 | A * | 10/2000 | Chang | 482/57 |
| 6,155,833 | A * | 12/2000 | Lenihan | 434/29 |
| 6,540,470 | B2 * | 4/2003 | Smith et al. | 414/430 |
| 7,108,635 | B2 * | 9/2006 | Howlett-Campanella | 482/23 |
| 7,326,151 | B2 * | 2/2008 | Peterson et al. | 482/61 |
| 2005/0209064 | A1 * | 9/2005 | Peterson et al. | 482/61 |

FOREIGN PATENT DOCUMENTS

| | | | |
|---|---|---|---|
| EP | 270256 | A2 * | 6/1988 |
| GB | 2195549 | A * | 4/1988 |

* cited by examiner

*Primary Examiner*—Loan H Thanh
*Assistant Examiner*—Sundhara M Ganesan
(74) *Attorney, Agent, or Firm*—George L. Williamson

(57) ABSTRACT

Method and apparatus for allowing a person with disabilities to learn to pedal a conventional bicycle which device also converts a conventional bicycle into an in-place exercise bike. In the bike trainer embodiment, the device allows the training wheels which are attached to the rear wheel of a bicycle to be elevated by being placed in a right and left trough of the base of the device so that the rear wheel of the bicycle is elevated off the ground and spins freely in a space between the right and left troughs. In the exercise bicycle embodiment, an adjustable rear roller assembly can be attached to the base of the device so that the rear wheel of the bicycle rests on a pair of rollers so as to allow the rear wheel of the bicycle to contact and roll on a front and rear roller so as to increase pedaling resistance while the front wheel of the bicycle is stabilized by a stand having a pair of adjustable upright members and a pair of laterally extending members for maintaining the bicycle in a stable position. Other embodiments are also disclosed.

10 Claims, 8 Drawing Sheets

BIKE TRAINER

BACKGROUND OF THE INVENTION

1. Field of the Invention

The present invention generally relates to bicycles and, more particularly to a combination child bicycle trainer and adult exercise bicycle.

2. Description of the Prior Art

Bicycle trainers and exercise bikes have been described in the prior art. However, none of the prior art discloses the unique features of the present invention.

An Information Disclosure Statement is attached to this specification.

While these bicycle trainers and exercise bikes may be suitable for the purpose for which they were designed, they would not be suitable for the purposes of the present invention as hereinafter described.

SUMMARY OF THE PRESENT INVENTION

The present invention discloses an apparatus and method for allowing a person with disabilities to learn to pedal a conventional bicycle, stabilized by training wheels, which device also converts a conventional bicycle into an in-place exercise bike. In the bike trainer for disabled people embodiment, the device allows the training wheels which are attached to the rear wheel of a bicycle to be elevated by being placed in a right and left trough of the base of the device so that the rear wheel of the bicycle is elevated off the ground and spins freely in a space between the right and left troughs. In the exercise bicycle embodiment, an adjustable roller assembly can be attached to the base of the device so that the rear wheel of the bicycle rests on a pair of rollers so as to allow the rear wheel of the bicycle to contact and roll on the front and rear roller so as to provide an in-place exercise bicycle while the front wheel of the bicycle is held in place by a stand having a pair of adjustable upright members and a pair of laterally extending members for maintaining the bicycle in a stable position.

An object of the present invention is to allow a person with motor planning disabilities to easily learn to pedal a conventional bicycle. A further object of the present invention is to allow a person to learn to pedal a bicycle without subjecting the person to the dangers of a traffic environment or the distraction of operating a moving bicycle. A further object of the present invention is to provide an apparatus that can convert a conventional bicycle into a stationary exercise bicycle. A further object of the present invention is to provide a device which can be easily and cheaply manufactured and to accommodate a variety of wheel sizes.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 3:
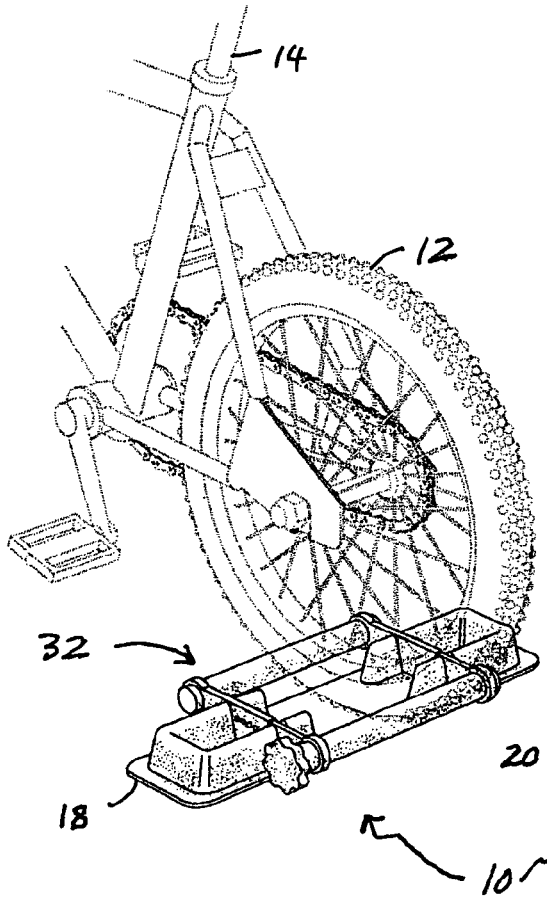
FIG. 3 is a perspective view of one embodiment of the present invention shown in operative connection.

With regard to reference numerals used, the following numbering is used throughout the drawings.

10 present invention
12 rear wheel
14 bicycle
16 user
18 base
20 trough
21 wall
22 training wheel
24 space
26 support member
28 axle
30 front wheel
31 front wheel stand
32 roller assembly
33 front fork
34 notch
36 roller
38 tension adjustment
40 adjustable upright support
42 base member
44 lateral support member
46 adjustable side rails
48 height adjustment
50 axle
52 notch
54 arrow
56 mat
58 longitudinal lines
60 transverse lines
62 base
64 front roller
66 rear roller
67 space
68 notch
69 bottom

70 bore
71 front portion
72 recess
73 rear portion
74 central space
76 front wheel stand
78 base frame
80 frame member
82 frame member
84 upright member
86 cross member
88 base member
90 lateral support
91 pivotal attachment
92 upper platform
94 hole
96 locking member
98 base
100 body
101 bore
102 axle
104 handle
106 left space
108 right space
110 enlarged end
112 fastener

DETAILED DESCRIPTION OF THE PREFERRED EMBODIMENT

The following discussion describes in detail at least one embodiment of the present invention. This discussion should not be construed, however, as limiting the invention to those particular embodiments since practitioners skilled in the art will recognize numerous other embodiments as well. FIGS. 1-11 illustrate the present invention wherein a trainer/exercise bike is disclosed.

Figure 1:
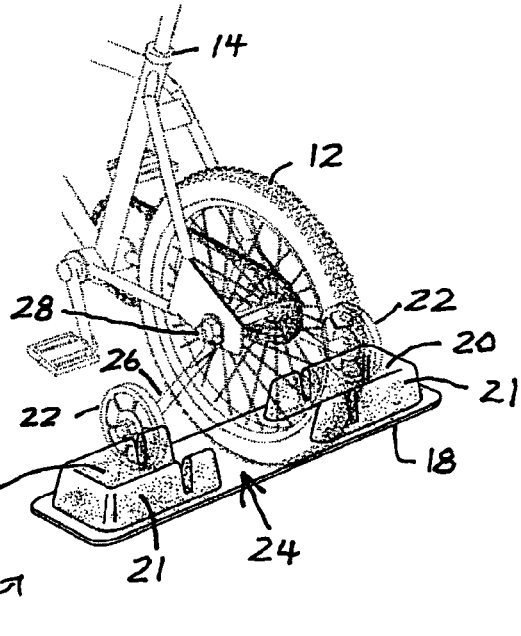
FIG. 1 is a perspective view of one embodiment of the present invention shown in operative connection.

Turning to FIG. 1, shown therein is the present invention 10 showing base 18 being placed underneath the rear wheel 12 of a conventional bicycle 14 for receiving a user (not shown but see FIG. 2) to be seated thereon and for operation of the bicycle. The present invention 10 comprises a base 18 having a right and left trough 20 therein for receiving the corresponding right and left training wheels 22 which are attached to rear wheel 12 so as to elevate the rear wheel above the base 18 wherein the rear wheel 12 rotates in a space or opening 24 between the right and left troughs 20. Ends of the right and left troughs 12 are defined by an upwardly extending U-shaped wall structure 21 having an upper top or tip one trough being disposed on each end of base 18. Also shown is the bicycle 14 with base 18 having right and left troughs 20 having the rear wheel 12 elevated above the space 24 by the rear training wheels 22 having a support member 26 thereon which connect the training wheels to the axle 28 of the rear wheel. The training wheels 22 are supported on the top of the wall 21 due to the fact that the troughs 20 are sized to support the training wheels.

Figure 2:
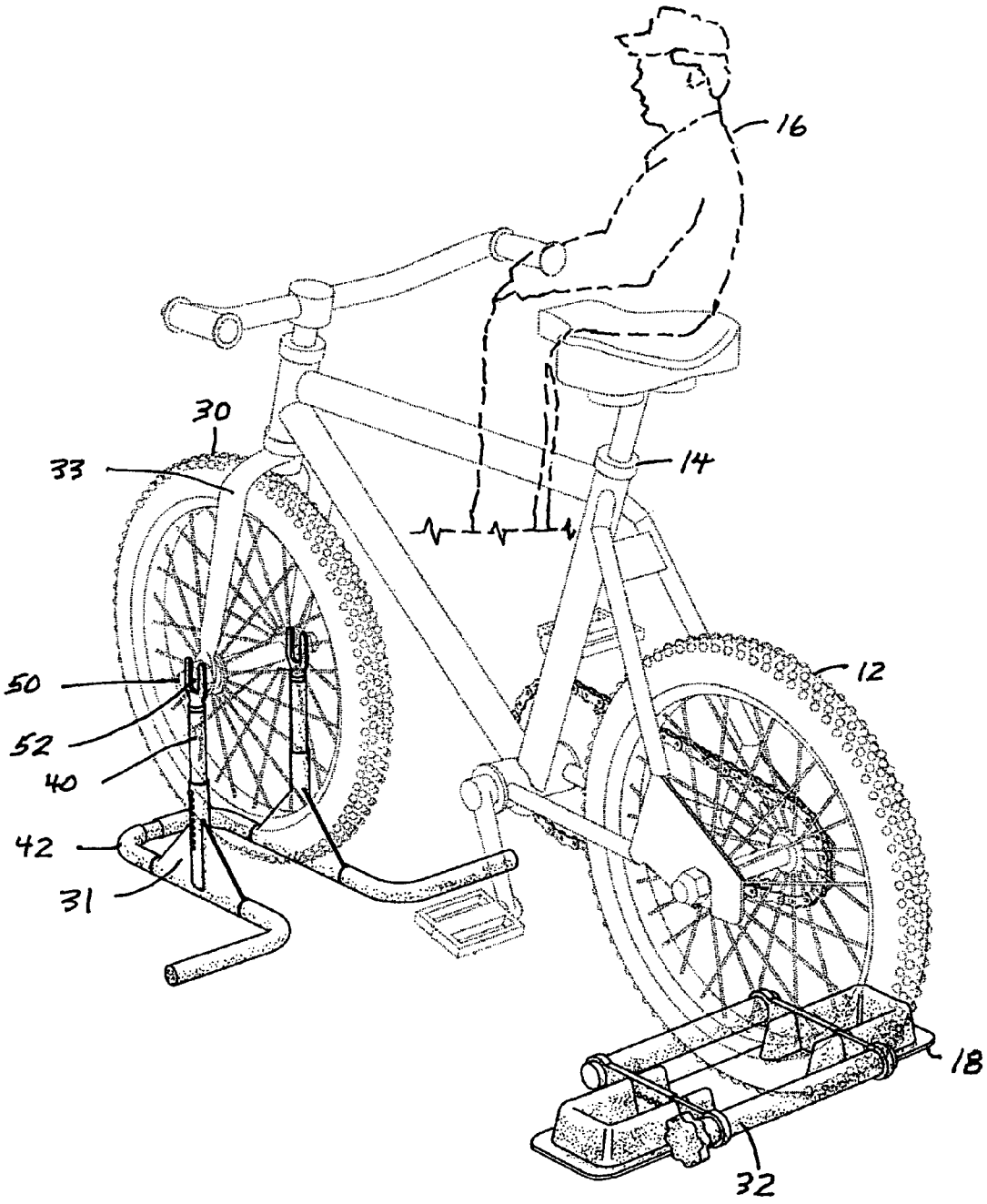
FIG. 2 is a perspective view of one embodiment of the present invention shown in operative connection.

Turning to FIG. 2, shown therein is user 16 on bicycle 14 having a rear wheel 12 and a front wheel 30 wherein the front wheel 30 is elevated off of the ground by being mounted onto a front wheel stand 31 having a base member 42. A rear wheel 12 is mounted onto the base 18 which contains an adjustable roller assembly 32 which allows the rear wheel to be placed thereon and allow the bicycle to operate as a stationary bicycle. Each end of the axle 50 of front wheel 30 is supported in a corresponding notch 52 on the upper end of the corresponding upright support 40.

Turning to FIG. 3, shown therein is the rear wheel 12 of the bicycle 14 mounted in an adjustable front and rear roller assembly 32 mounted onto the base 18 in a second embodiment.

Figure 4:
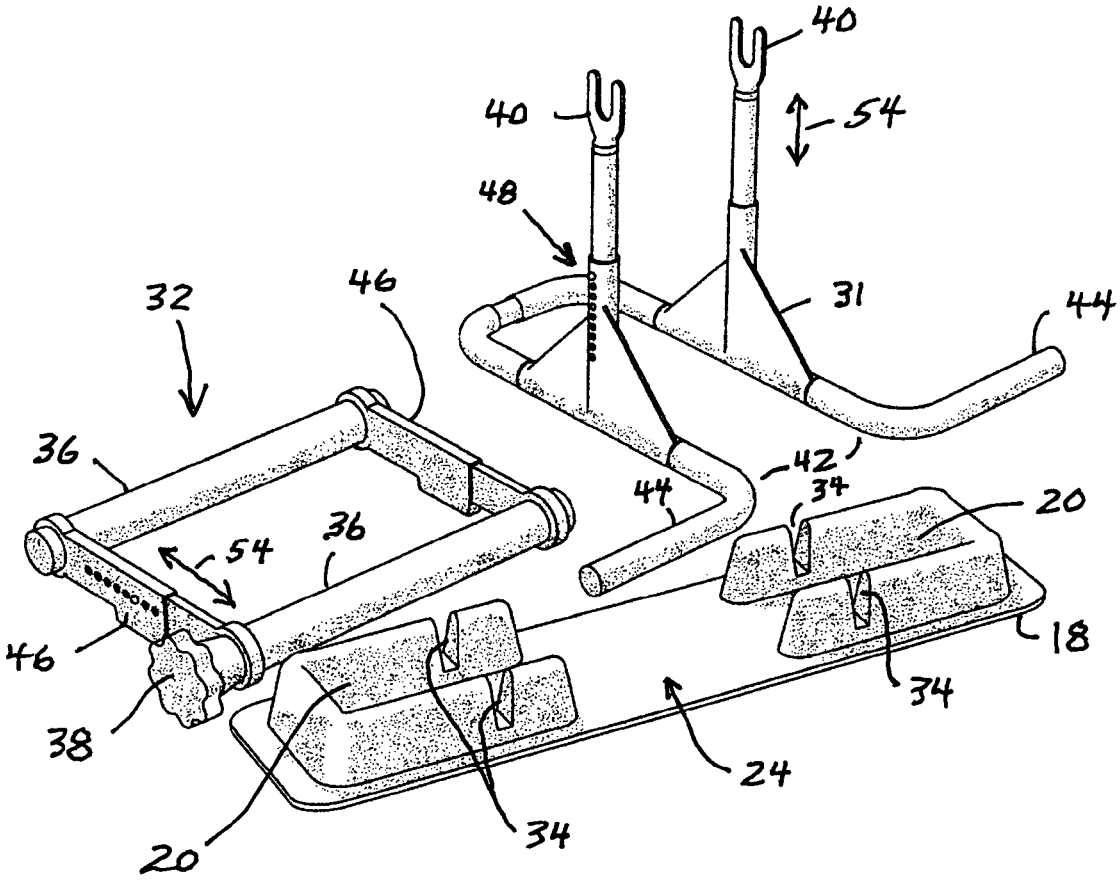
FIG. 4 is a perspective view of portions of the present invention.
Figure 5:
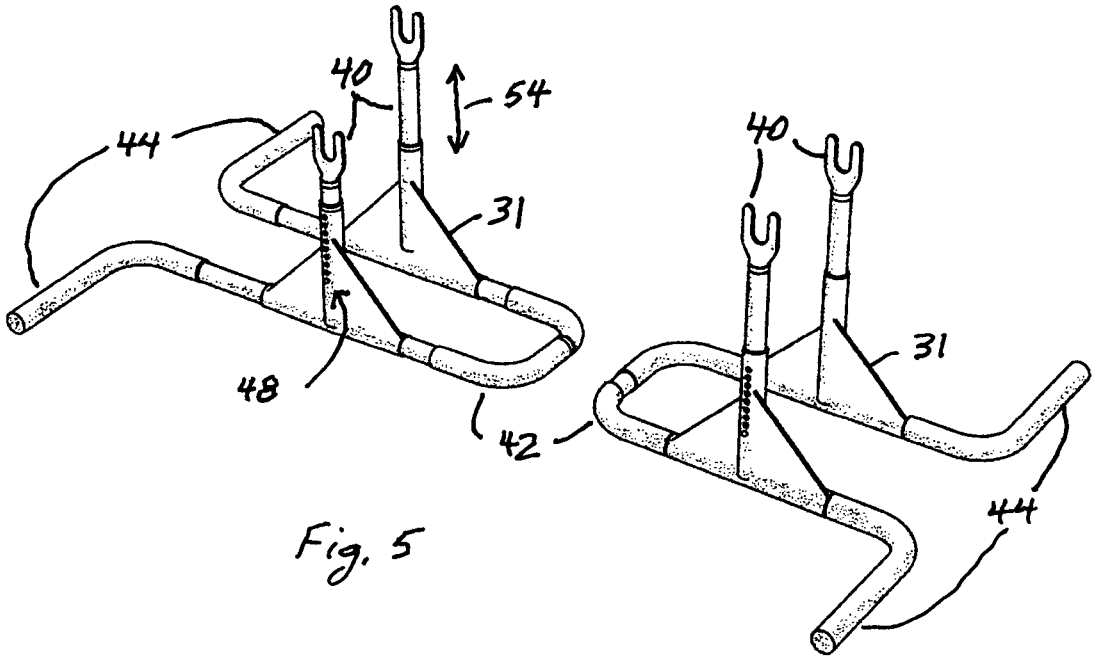
FIG. 5 is a perspective view of portions of the present invention.
Figure 6:
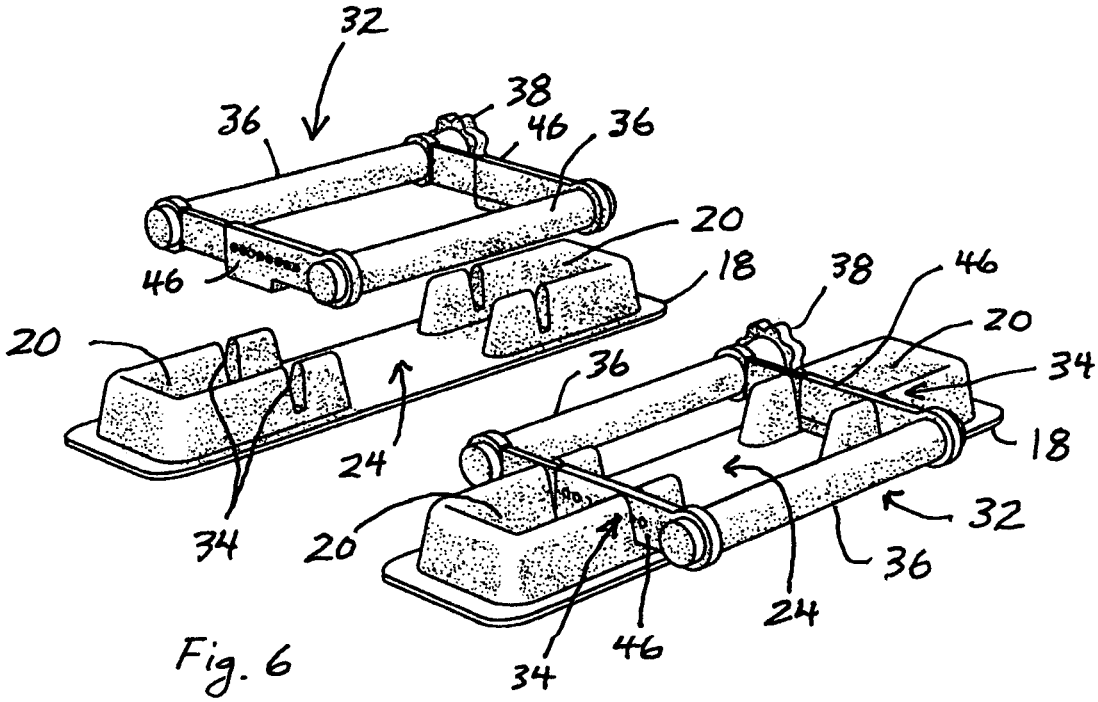
FIG. 6 is a perspective view of portions of the present invention.

Turning to FIGS. 4-6, shown therein is the base 18 having a right and left trough 20 along with a space 24 therein between also having a plurality of recesses or notches 34 cut in the walls of the troughs for receiving the sides 46 of the roller assembly 32. Also shown is the roller assembly 32 having front and rear rollers 36 wherein the rear roller has a tension adjustment means 38 wherein the rear roller can be tension-adjusted to adjust the tension on the rear wheel of the bicycle and the distance between the front and rear rollers 36 can be varied by means of left and right slidably adjustable side rails 46 indicated by arrows 54. Also shown is the front wheel elevation assembly 31 having right and left upright supports 40 for attachment to the axle of the front wheel for elevating the front wheel off of the ground along with a ground contacting base member 42 having a pair of lateral extending side members 44 which level and stabilize the bicycle in a lateral direction. The upright support members 40 front wheel stand 31 have means for being independently telescopically height adjustable at 48 which comprises a plurality of spaced apart holes in the female portion and outwardly biased balls in the male portion. Arrow 54 indicates height adjustability.

In operation, regarding the embodiments shown in FIGS. 1-6, the training wheels 22 of the present invention 10 rest in troughs 20 of the plastic base 18. The rear wheel 12 is raised approximately one inch from the ground while spinning freely in the space 24 between the troughs 20. By snapping a roller set or assembly 32 onto the base 18 and adding a height adjustable stand 31 to the front wheel 30, pedaling resistance can be varied. The resistance on the rear wheel 12 can be adjusted by use of a knob 38 or other means to increase resistance on the roller set assembly 32.

Figure 7:
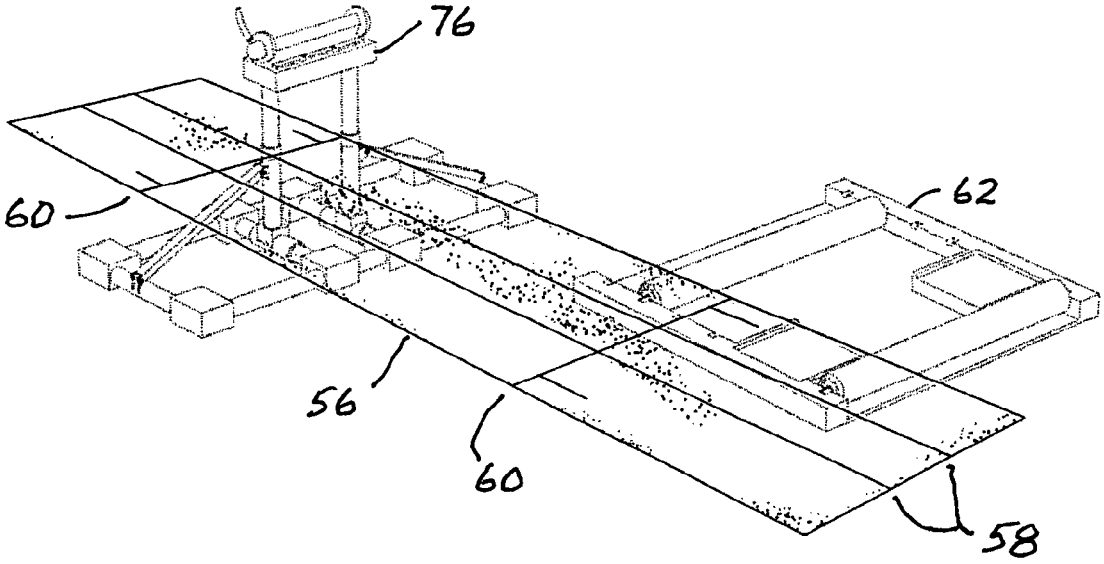
FIG. 7 is a perspective view of portions of the present invention.

Turning to FIG. 7, therein is shown an alignment mat 56 being rectangular in shape having a pair of generally centrally disposed longitudinal lines 58 running along the longitudinal axis of the mat along with a pair of transverse lines 60. The front wheel and rear wheel of the present invention are aligned with the lines 58 to assure that the present invention has its front and rear wheels in alignment with each other. Also the front wheel stand 76, or Item 31 of FIG. 4, and the rear wheel base 62, or Item 18 of FIG. 4, are aligned with lines 60 of mat 56 so as to keep the front wheel stand, the rear base member, and the bike perpendicular to the ground.

Figure 8:
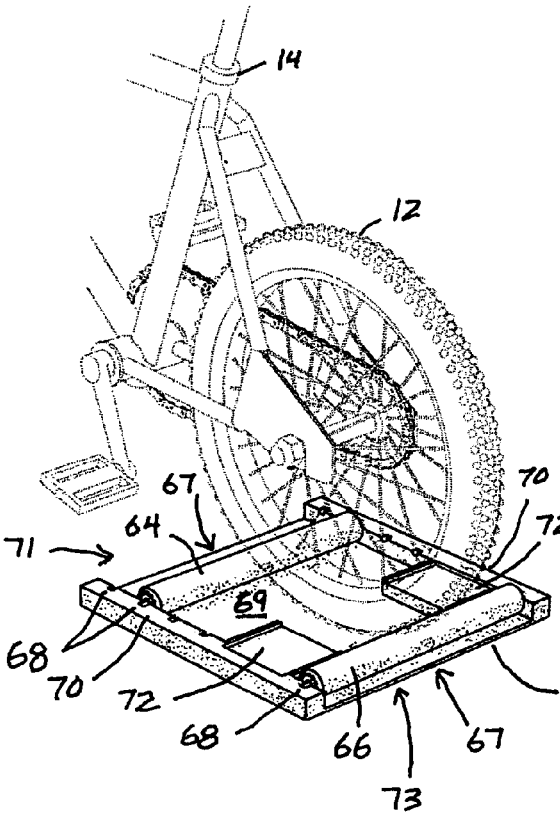
FIG. 8 is a perspective view of portions of the present invention.
Figure 9:
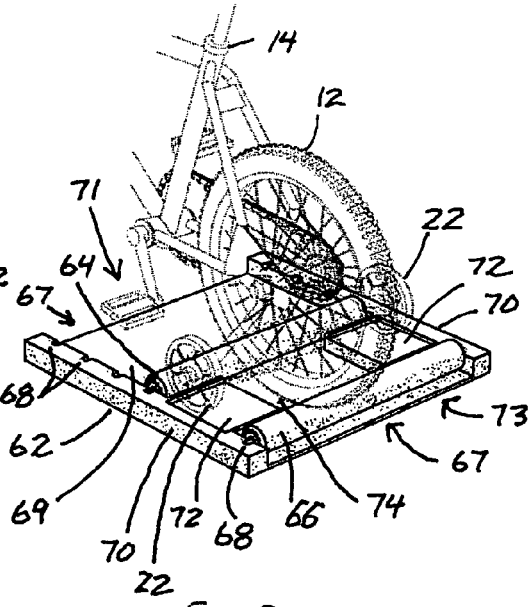
FIG. 9 is a perspective view of portions of the present invention.

Turning to FIGS. 8-9, therein is shown as alternative design being the preferred embodiment of the rear wheel base 62 having a front roller 64 and a rear roller 66 disposed therein wherein each end of the rollers 64, 66 are disposed in notches 68 which are placed in the side walls 70 so that the rollers 64, 66 are rotatable in the space 67 provided between the side walls 70 and bottom 69. Note that a plurality of notches 68 are provided in a front portion 71 of the base 62 and a plurality of notches 68 are provided in a rear portion 73 of the base 62. Also shown is a recessed or trough area 72 of the base 62 wherein the corresponding left and right training wheels 22 of the bicycle 14 can be secured therein. In operation, the training wheels of the bicycle can be placed in the recesses 72 of base 62 so that the rear wheel 12 of the bicycle rotates in central space 74 so that the rear wheel can be placed in contact with either or both roller 64 or 66 or the rear wheel of the bicycle can be disposed in a spaced apart relationship with the rollers 64, 66 so that the rear wheel of the bicycle does not contact either roller 64, 66. Alternatively, when the bicycle 14 is used without training wheels, roller 66 can be moved to the front portion of base 62 so that the rear wheel of the bicycle can be placed in contact with the upper surface of both rollers 64, 66 so that the rear wheel of the bicycle can be operated in contact with the rollers so as to allow the rear wheel of the bicycle to rotate on top of rollers 64, 66. In all scenarios of operation, rollers 64, 66 can be moved so as to change the tension on the rear wheel 12 of the bicycle 14. Also, note that the base 62 can be turned around or rotated so that the portions 71, 73 of the base are reversed with respect to the bike 14, i.e., so that portion 71 is oriented toward the rear and portion 73 is oriented toward the front.

Figure 10:
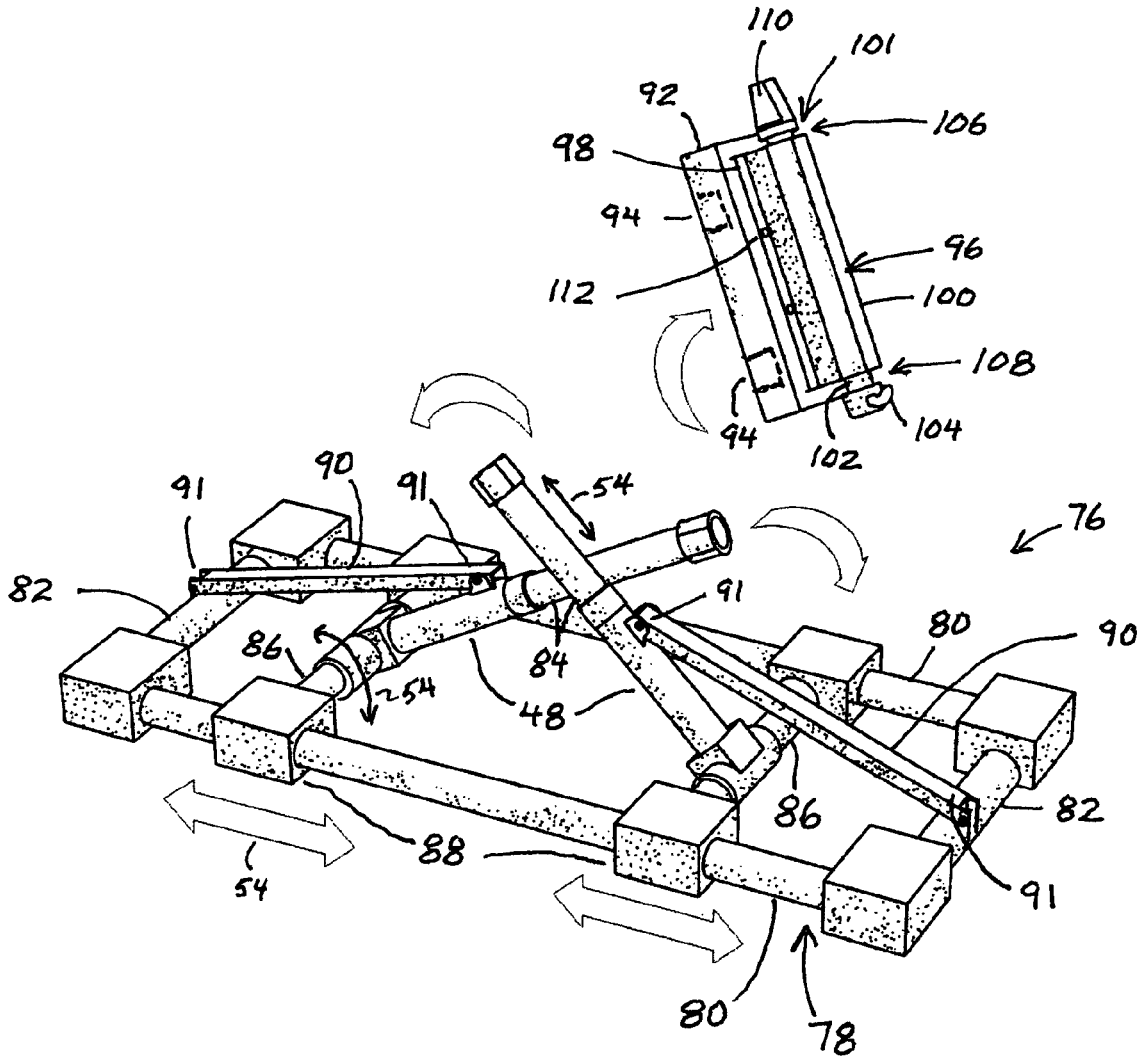
FIG. 10 is a perspective view of portions of the present invention.
Figure 11:
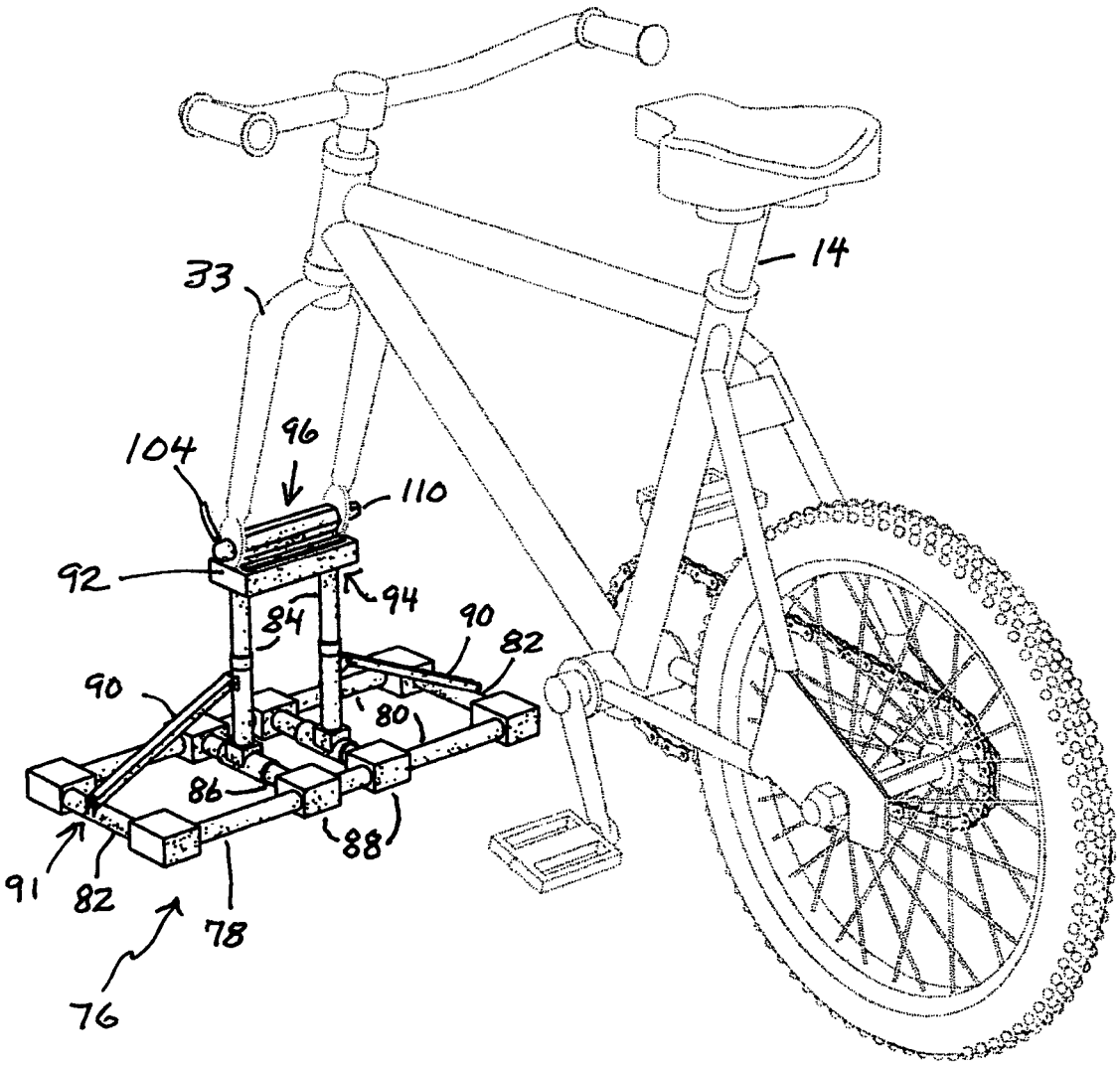
FIG. 11 is a perspective view of portions of the present invention.

Turning to FIGS. 10-11, therein is shown an alternative design being the preferred embodiment of the front wheel stand 76 having a generally rectangular base frame portion 78 having individual frame members 80, 82 which form sides and ends, respectively, of the base 78. Also note that a pair of upright standing members 84 are rotatably mounted on cross members 86 which are rotatably attached to members 88 which members 88 are slideable along the frame members 80. Note that upright members 84 are telescopically adjustable, similarly to the front wheel stand 31 of FIG. 4 as previously disclosed, having height adjustment members 48 disposed thereon so that upright members 84 can be vertically height adjusted. Note the pair of lateral support members 90 pivotally attached between members 84, 82 being pivotally attached at 91 so that the upright standing members 84 can be folded toward the horizontal whenever the members 88 are moved toward the corresponding end 82 of the base 78. Also shown is a removable upper platform member 92 having on its bottom side a pair of recesses or holes 94 (shown in hidden lines on FIG. 10) therein for receiving the upper ends of the upright members 84 for stabilizing the upright members 84 in the vertical position and providing a base to which to mount the locking member means 96. Locking member means 96 has a base 98 thereon which is attached with fasteners 112 to the top of platform 92 along with a body 100 which has a bore 101 therein within which axle 102 is moveable in substantially the horizontal plane. Axle 102 moves in response to the rotation of handle 104 so that the left space 106 and right space 108 can be either widened or narrowed so that the front fork 33 of bike 14 can be removably frictionally locked and/or secured in or released from the locking member means 96. Space 106 is disposed between the inner surface of enlarged end 110 and body 100 and space 108 is disposed between the inner surface of handle 104 and body 100. Arrow 54 indicates rotation or height/length adjustment.

The present invention 10 accommodates a wide range of tire sizes from child to adult on either standard or recumbent bicycles. The unit can be sold in two parts comprising an inexpensive base 18, 62 that provides dual functionality as a low resistance training device or combined with the adjustable roller assembly 32 or rollers 64, 66 for increased resistance. The present invention 10 works with any size bicycle upon which the rider is pedaling for therapy or for exercise.

I claim:

1. An apparatus for supporting a bicycle, the bicycle having a front fork, a rear end, and front and rear wheels disposed thereon, the bicycle being operable in a stationary position, comprising:

a) a pair of training wheels mounted on opposite sides of said rear wheel;

b) a base having front and rear ends, first and second upwardly extending side walls and a bottom, each said side wall having a plurality of notches disposed therein, said notches on said side walls being aligned with each other said side walls and;

c) a front roller being removably disposed in said notches so that said front roller may be moved between pairs of aligned notches and a rear roller being moveably disposed in notches adjacent the rear end of said base, wherein each of said front and rear rollers can be moved from one set of notches to another set of notches;

d) c) first and second raised and defined recesses being disposed on said base between said front and rear ends of said base, said first recess being disposed contiguous to said first side wall and said second recess being disposed contiguous to said second side wall, each of said recesses being adjacent said rear roller, wherein each said recess receives and supports a training wheel of the bicycle, and a central space between said recesses to accommodate said rear wheel;

e) whereby a user riding said bicycle with training wheels can drive said rear wheel freely and without contact with said rollers or base, both of said training wheels being in contact with and supported by upper surfaces of said recesses; and, f) whereby said rollers are moveable to notches to support said rear wheel when said bicycle is being used on said base without training wheels.

2. The apparatus of claim 1, further comprising an alignment mat to permit the front and rear wheels of the bicycle to be aligned and for the bicycle to be perpendicular to the ground, wherein said mat has a plurality of longitudinal and transverse lines disposed thereon, wherein the front and rear wheels of the bicycle are aligned with said longitudinal lines.

3. The apparatus of claim 1, further comprising:

a) a front wheel stand, said front wheel stand having a base frame member;

b) said base frame member being generally rectangular shaped having first and second frame members corresponding to each of the first and second sides and third and fourth frame members corresponding to each of the first and second ends;

c) first and second cross members, each said cross member having a first end being slidably disposed on said first side of said base frame member and a second end being slidably disposed on said second side of said base frame member wherein each said cross member is rotatable in the horizontal plane;

d) first and second upright members, an upper platform member, each said upright member having a lower end adapted for connection to a corresponding said cross member and an upper end adapted for connection to said upper platform member, wherein each said upright member can be rotated on said corresponding cross member from an upright position to a substantially horizontal position, wherein each said upright member can be telescopically adjusted in length;

e) means for a locking member whereby the front fork of the bicycle can be locked thereto and released therefrom, wherein said means for a locking member further comprises a body portion mounted onto a base, said body portion having a bore therein, said bore passing entirely through said body portion, said base being connected to said upper platform member, a single axle having first and second ends being disposed in said bore wherein said axle moves in said bore in response to rotation of a single handle disposed on one end of said axle, said axle being disposed substantially perpendicular to the rear wheel of the bicycle, said first and second ends of said axle each having a space disposed adjacent thereto so that a corresponding end of the front fork of the bicycle can be disposed therein, and, wherein each front fork of the bicycle can be locked to said axle and released from said axle in response to rotation of said handle.

4. The apparatus of claim 3, further comprising an alignment mat to permit the front and rear wheels of the bicycle to be aligned and for the bicycle to be perpendicular to the ground, wherein said mat has a plurality of longitudinal and transverse lines disposed thereon, wherein the front and rear wheels of the bicycle are aligned with said longitudinal lines.

5. A method for supporting a bicycle for stationary use both with and without training wheels mounted thereon, comprising the steps of:

a) placing a rear wheel of the bicycle in a base having front and rear ends, first and second upwardly extending side walls and a bottom, each side wall having a plurality of notches disposed therein, front and rear spaces being defined by the side walls and the bottom;

b) supporting the rear wheel of the bicycle on a front roller and a rear roller, the front roller being removably disposed in the front space between the notches and the rear roller being moveably disposed in the rear space, wherein each of the front and rear rollers can be moved from one set of notches to another set of notches;

c) mounting a training wheel on each side of said rear wheel, the base having first and second raised and defined recesses between said front and rear ends of said base, said first recess being disposed contiguous to said first side wall and said second recess being disposed contiguous to said second side wall, each of said recesses being adjacent said rear roller, wherein each said recess receives and supports a training wheel, a central space being formed between said recesses to accommodate said rear wheel spaced from a top surface of said base;

d) moving said rollers out of contact with said rear wheel whereby said bicycle is operated either with said training wheels supporting a rear end of said bicycle or without training wheels and said rear wheel being supported by said rollers; and, e) supporting a front fork of said bicycle for stationary operation of said bicycle.

6. The method of claim 5, further comprising the step of placing the bicycle on an alignment mat to permit the front and rear wheels of the bicycle to be aligned and for maintaining the bicycle perpendicular to the ground, wherein the mat has a plurality of longitudinal and transverse lines disposed thereon, wherein the front and rear wheels of the bicycle are aligned with the longitudinal lines.

7. In combination, a bicycle and apparatus for supporting said bicycle, comprising:

a) said bicycle having a front fork, a rear end, and front and rear wheels disposed thereon, and training wheels disposed on opposite sides of said rear wheel;

b) said apparatus comprising a base having front and rear edges, first and second side edges and a bottom, and first and seconds pairs of spaced front and rear walls on said base parallel to and adjacent said front and rear edges, respectively, said first pair being adjacent a first side edge and the second pair being adjacent the second side edge of said base, distal ends of said front and rear walls adjacent side edges of said base being joined by a side wall forming a U-shaped wall structure adjacent each side edge of said base, each of said walls having a notch, the notch in each of the front and rear walls being aligned with each other;

c) a roller assembly comprising front and rear rollers parallel with front and rear edges of said base, respectively, supported by a pair of side members removably resting in aligned notches in said front and rear walls of each pair of front and rear walls;

d) first and second recesses formed in a space between said rear wheel and each side wall of each said U-shaped wall structure to accommodate said training wheels;

e) whereby said training wheels in contact with said front and rear walls support the rear end of said bicycle with said rear wheel raised above and free of any contact with said base allowing a disabled user to operate said bicycle when said roller assembly is removed from said base; and, f) whereby said rear wheel of said bicycle is supported by said front and rear rollers, and said training wheels are above and not simultaneously in contact with said walls when said roller assembly is deployed on said base.

8. The combination of claim 7 in which lengths of said side members of said roller assembly are adjustable.

9. The combination of claim 8 in which one of said rollers has a knob to adjust resistance in said roller assembly.

10. In combination, a bicycle and apparatus for supporting said bicycle both with and without training wheels, for stationary use, comprising:

a) said bicycle having a front fork, a rear end, a rear wheel, and training wheels being removable and disposed on opposite sides of said rear wheel;

b) said apparatus comprising a base for supporting said training wheels while suspending said rear wheel above and out of contact with said base and alternatively, upon removal of said training wheels, supporting said rear wheel on a pair of spaced rollers;

c) said apparatus having means for adjusting the spacing between said rollers; and d) means for adjusting resistance of said rollers to rotation of said rear wheel.

* * * * *